US009863437B2

(12) United States Patent
Weng et al.

(10) Patent No.: US 9,863,437 B2
(45) Date of Patent: Jan. 9, 2018

(54) VENTILATING FAN

(71) Applicants: Panasonic Ecology Systems Guangdong Co., Ltd., Foshan, Guangdong (CN); Panasonic Corporation, Osaka (JP)

(72) Inventors: Yefan Weng, Guangdong (CN); Zhengnan Zeng, Guangdong (CN); Shouyong Gao, Guangdong (CN); Bodong Zhong, Guangdong (CN); Daisuke Tsubosa, Aichi (JP)

(73) Assignees: PANASONIC ECOLOGY SYSTEMS GUANGDONG CO., LTD., Foshan, Guangdong (CN); PANASONIC CORPORATION, Osaka (JP)

( * ) Notice: Subject to any disclaimer, the term of this patent is extended or adjusted under 35 U.S.C. 154(b) by 598 days.

(21) Appl. No.: 14/494,783

(22) Filed: Sep. 24, 2014

(65) Prior Publication Data

US 2015/0086354 A1 Mar. 26, 2015

(30) Foreign Application Priority Data

Sep. 25, 2013 (CN) ..... 2013 2 0594468 U

(51) Int. Cl.

| | |
|---|---|
| ***F04D 29/42*** | (2006.01) |
| ***F04D 29/52*** | (2006.01) |
| ***F04D 19/00*** | (2006.01) |
| *F24F 13/20* | (2006.01) |
| *F24F 7/007* | (2006.01) |

(52) U.S. Cl.

CPC ..... *F04D 29/522* (2013.01); *F04D 19/002* (2013.01); *F04D 29/422* (2013.01); *F04D 29/4226* (2013.01); *F24F 7/007* (2013.01); *F24F 13/20* (2013.01)

(58) Field of Classification Search

CPC .. F04D 29/522; F04D 29/422; F04D 29/4226; F04D 29/4233; F04D 29/424; F04D 29/4264; F04D 29/4253; F04D 29/40; F04D 29/403; F04D 29/541; F04D 29/545; F04D 29/603; F04D 19/002; F04D 25/08; F04D 25/088; F24F 7/007; F24F 13/00; F24F 13/20; F24F 1/38; F24F 1/56; F24F 2013/203; F24F 2001/0037; F05B 2240/14; F05B 2250/32; F05B 2250/21; F05B 2250/13

USPC ..... 415/203, 204, 211.2, 212.2, 213.1, 214.1

See application file for complete search history.

(56) References Cited

FOREIGN PATENT DOCUMENTS

JP 2009186060 A * 8/2009

* cited by examiner

*Primary Examiner* — Gregory Anderson
*Assistant Examiner* — Danielle M Christensen
(74) *Attorney, Agent, or Firm* — RatnerPrestia

(57) ABSTRACT

The present invention provides a ventilating fan. In the ventilating fan, first and second flangings are extended outwards from vertical side edges and horizontal side edges of the air inlet of the adapter respectively, outer edges of the first flangings are firstly bent to form both side surface, and then edges of the both side surfaces are bent to form edge surfaces, and the first flangings, the side surfaces, and the edge surfaces confine open grooves; protrusions are disposed on an outer periphery of the air inlet, and a slot is formed between the protrusion and the first or the second flanging; and first folded sheets are extended outwards from both vertical side edges of the air outlet of the casing; and an edge of the air outlet of the frame abuts against and is clamped in the slot.

9 Claims, 11 Drawing Sheets

VENTILATING FAN

CROSS-REFERENCE TO RELATED APPLICATION

This application claims the benefit of Chinese Patent Application No. 201320594468.9 filed on Sep. 25, 2013 in the State Intellectual Property Office of China, the whole disclosure of which is incorporated herein by reference.

BACKGROUND OF THE INVENTION

1. Field of the Invention

The present invention relates to a ventilating fan, and particularly to a ventilating fan mounted between a roof and a ceiling.

2. Description of the Related Art

FIGS. 1A and 1B are schematic views of a well-known ventilating fan. The ventilating fan is a common ventilation apparatus. The well-known ventilating fan generally comprises a frame 11, a casing (not shown) mounted in the frame 11, and an adapter 15 fitted to an air outlet of the casing. The frame 11 is in a rectangular parallelepiped shape and has a bottom surface formed with an air inlet and a side surface provided with an air outlet 16. An engagement opening 17 is disposed on one side of the frame 11 where the air outlet 16 is formed, and a first through hole 18 is disposed on the other side. An engagement sheet 20 is disposed on one edge of the adapter 15 where an air inlet 19 is formed and a second through hole 14 corresponding to the first through hole 18 is disposed in the other edge. The ventilating fan mountable between a roof and a ceiling may be mounted by a mounting bracket or the like. The mounting steps are simply described as follows.

Firstly, the mounting bracket is mounted between joists, and then the frame 11 is mounted on the mounting bracket. After that, the adapter 15 is passed through the air outlet 16 at the side surface of the frame 11 from an inside of the frame 11, and the engagement sheet 20 of the adapter 15 is inserted into the engagement opening 17 of the frame 11, thereby achieving a temporary fixation of the adapter 15. Next, a screw is passed through the second through hole 14 of the adapter 15 and the first through hole 18 of the frame 11 so that the adapter 15 is mounted over the air outlet 16 of the frame 11.

In the mounting of the adapter 15 to the conventional ventilating fan, use of the screw is necessary. As a result, the number of the mounting steps and the man hour are increased, and the air tightness between the air outlet of the casing and the adapter 15 is bad because they are separated by the head of the screw after the casing has been mounted to the frame 11.

SUMMARY OF THE INVENTION

It is an object of the present invention to provide a ventilating fan of which an adapter can be simply and conveniently mounted to a frame.

In order to achieve the above object, there is provided a ventilating fan, it comprises a frame which has a bottom surface formed with an air inlet and a side surface provided with an air outlet; a casing in which a fan motor is mounted; and, an adapter fitted to an air outlet of the casing, wherein first flangings are extended outwards from both vertical side edges of an air inlet of the adapter, second flangings are extended outwards from both horizontal side edges of the air inlet of the adapter, outer edges of the first flangings are first bent towards the casing side to form both side surfaces perpendicular to the first flangings, and then edges of the both side surfaces are bent towards each other to form edge surfaces, and the firstly flangings, the side surfaces, and the edge surfaces confine open grooves; one or more protrusions are disposed on an outer periphery of the air inlet of the adapter near the first flanging or the second flanging, and a slot is formed between the protrusion and any one of the first and the second flangings; and first folded sheets are extended outwards from both vertical side edges of the air outlet of the casing; and an edge of the air outlet of the frame abuts against and is clamped in the slot such that the adapter is locked to the frame, and the first folded sheets is insertable into the open grooves of the adapter from below upwards.

Four side surfaces of the frame excluding a top surface and the bottom surface are inclined outwards and downwards from the top surface towards the bottom surface, and the air outlet at the side surface of the frame, the air inlet of the adapter, and the air outlet at the casing are parallel to one another.

The four side surfaces are inclined outwards and downwards from the top surface towards the bottom surface at an angle of 0.5-5 degrees.

A lower opening of the open groove is greater than an upper opening of the open groove, and the lower opening of the open groove is gradually narrowed upwards to form a guide groove.

The lower opening of the open groove is gradually narrowed upwards until the lower opening of the open groove is slightly wider than the folded sheet of the casing and closely clamps the folded sheet of the casing.

A second folded sheet is extended from a lower side edge of the air outlet of the casing towards an outside of the air outlet of the casing, and a lower portion of the second folded sheet is perpendicularly bent towards the adapter side to form a stop sheet; and when the adapter and the casing are connected together, the first and second flangings of the adapter and the first and second folded sheets of the casing abut against each other.

The casing is provided with a snap.

The snap is provided with a protrusion, and the frame is formed with an engagement groove corresponding to the protrusion.

An upper portion of the second flanging is perpendicularly bent towards the casing side to form a stop piece.

The ventilating fan according to the embodiment of the present invention is advantageous in that tightness between the adapter and the air outlet of the casing is higher.

DETAILED DESCRIPTION OF THE EMBODIMENTS

Figure 1A:
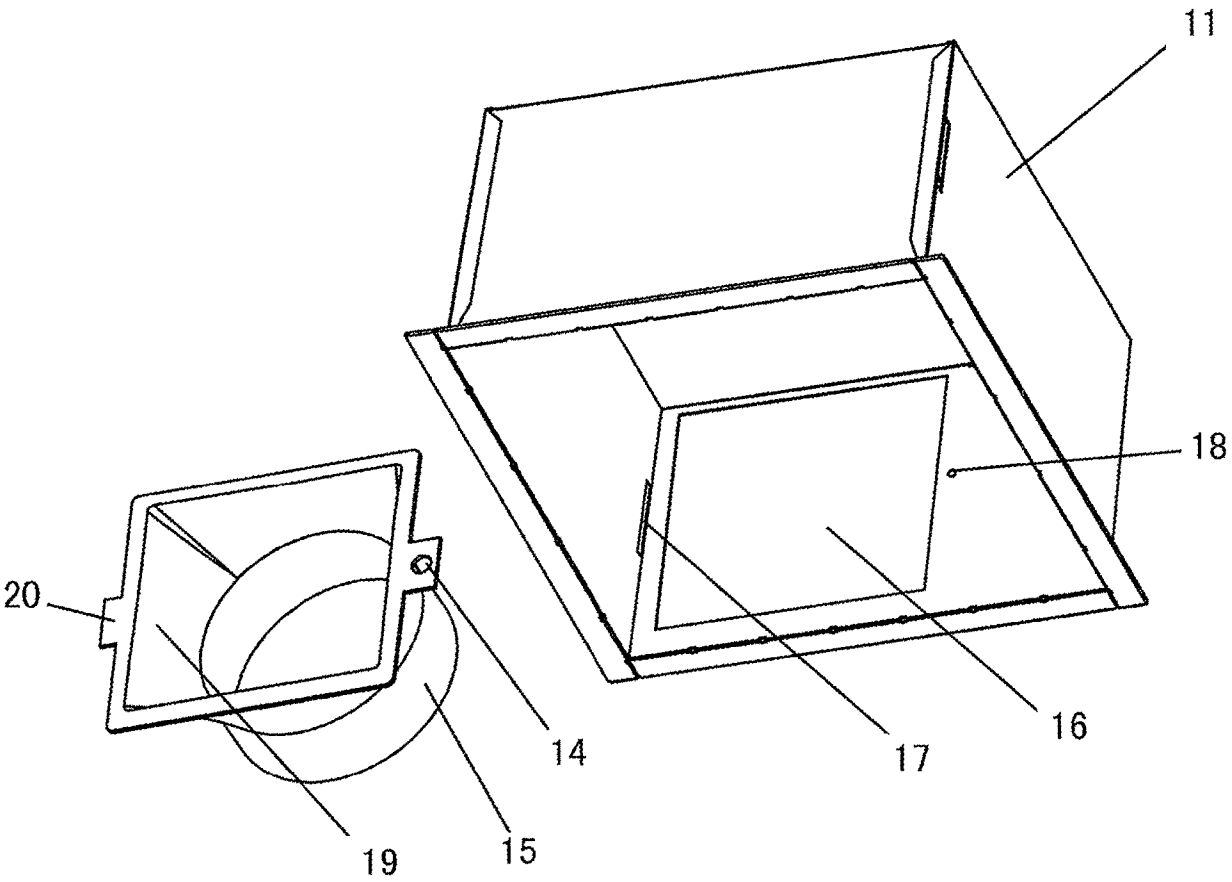
Fig. 1A Prior Art
FIGS. 1A and 1B are schematic views of a well-known ventilating fan.
Figure 1B:
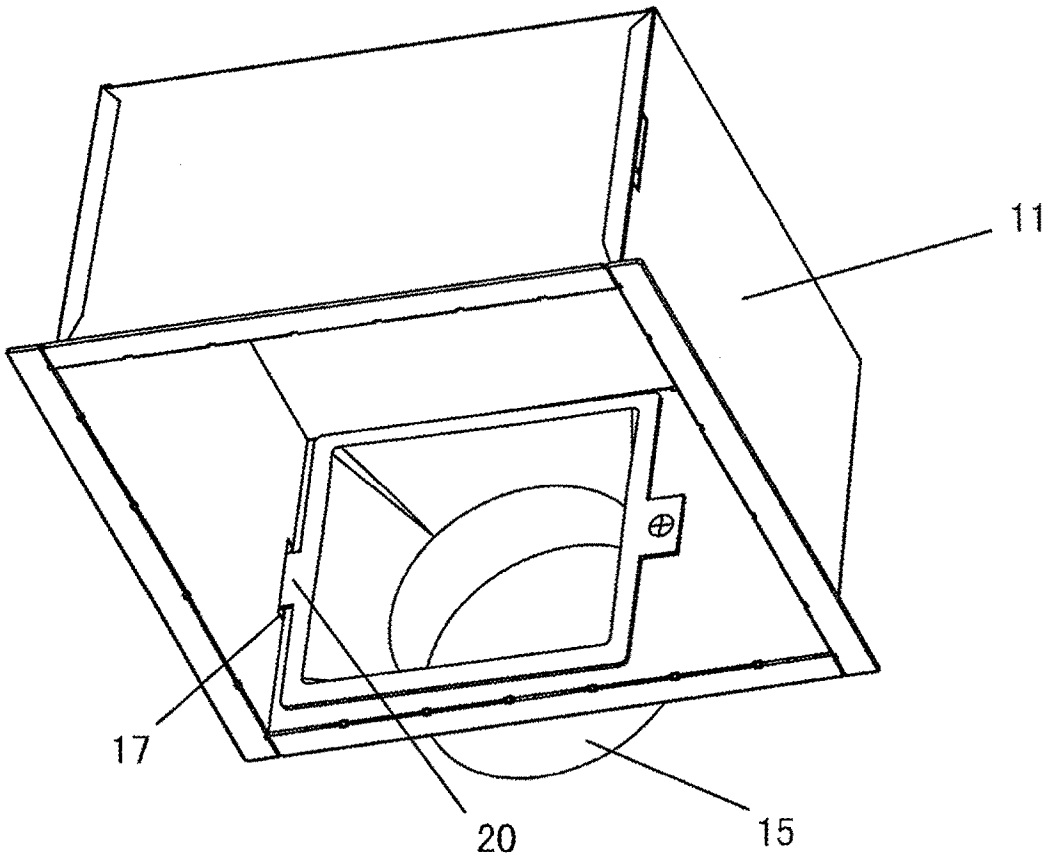
Fig. 1B Prior Art
Figure 2A:
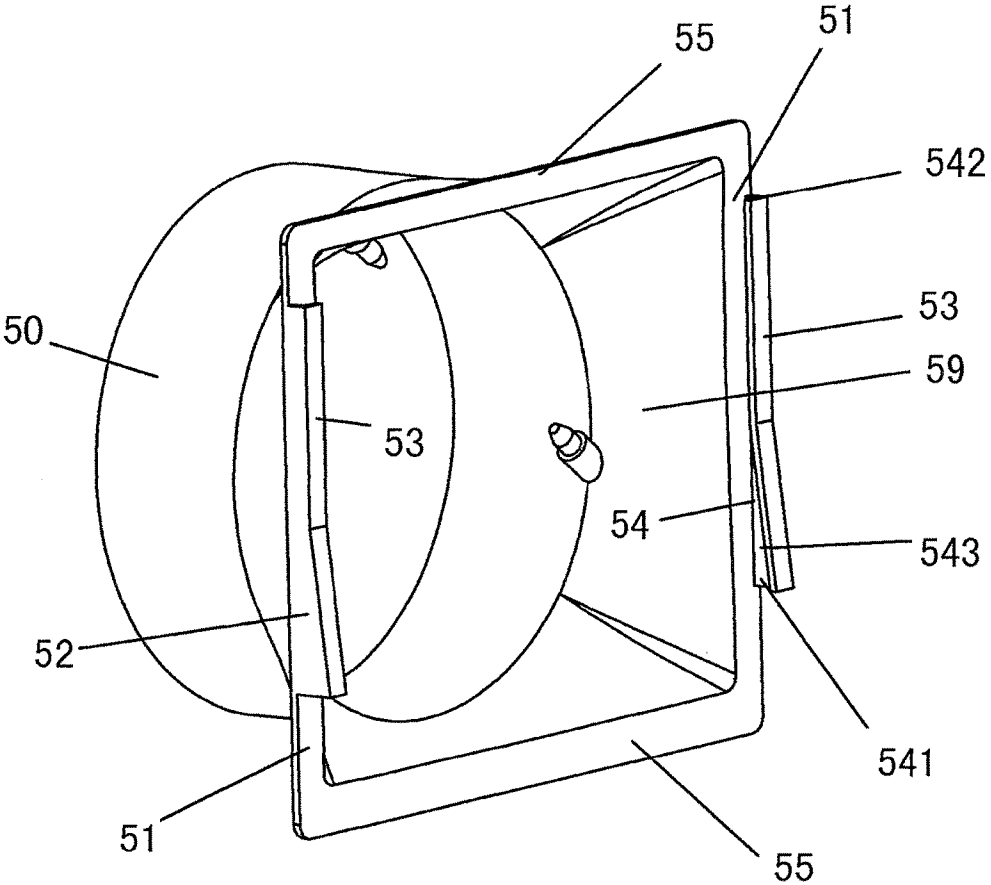
FIG. 2A is a schematic view of an adapter according to an embodiment of the present invention.
Figure 2B:
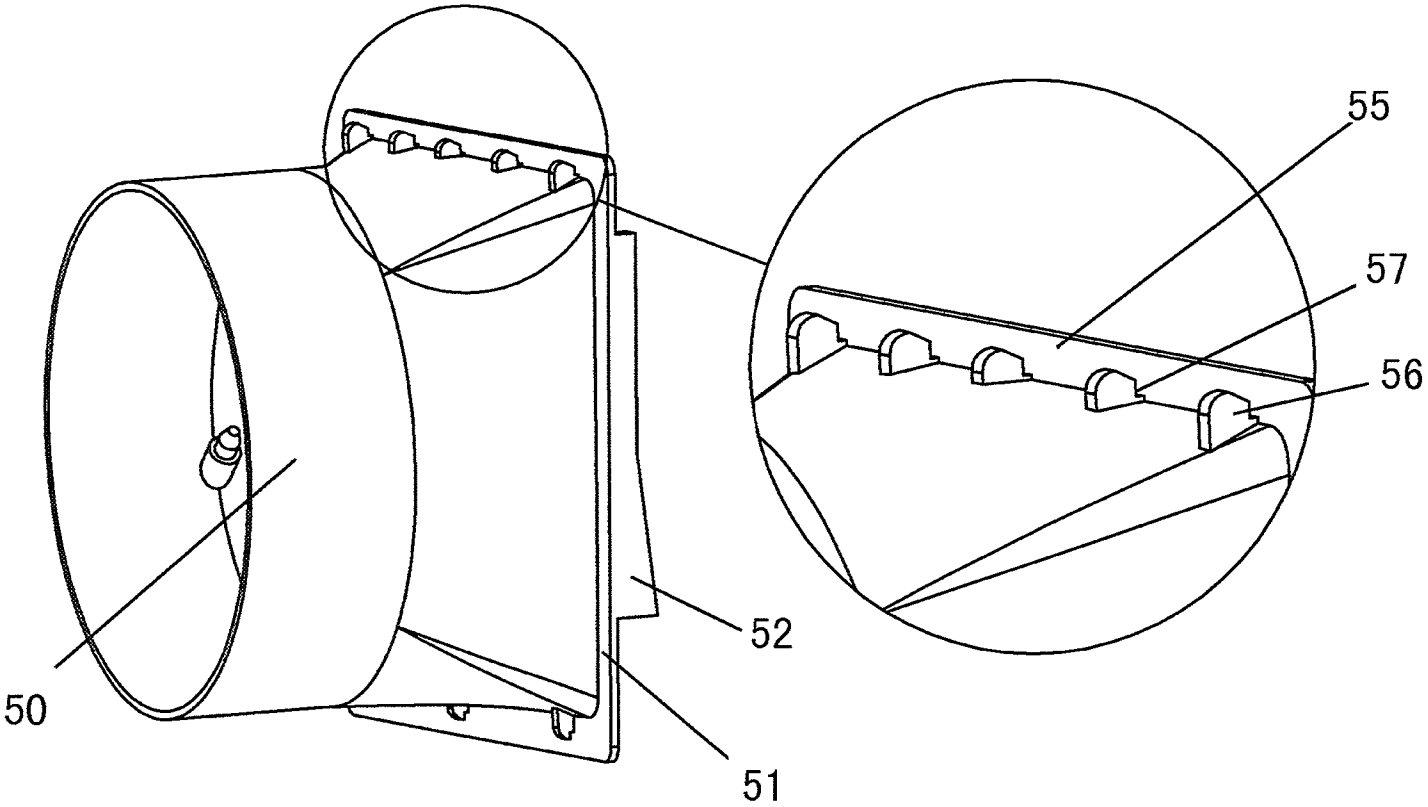
FIG. 2B is another schematic view of the adapter according to the embodiment of the present invention.
Figure 3:
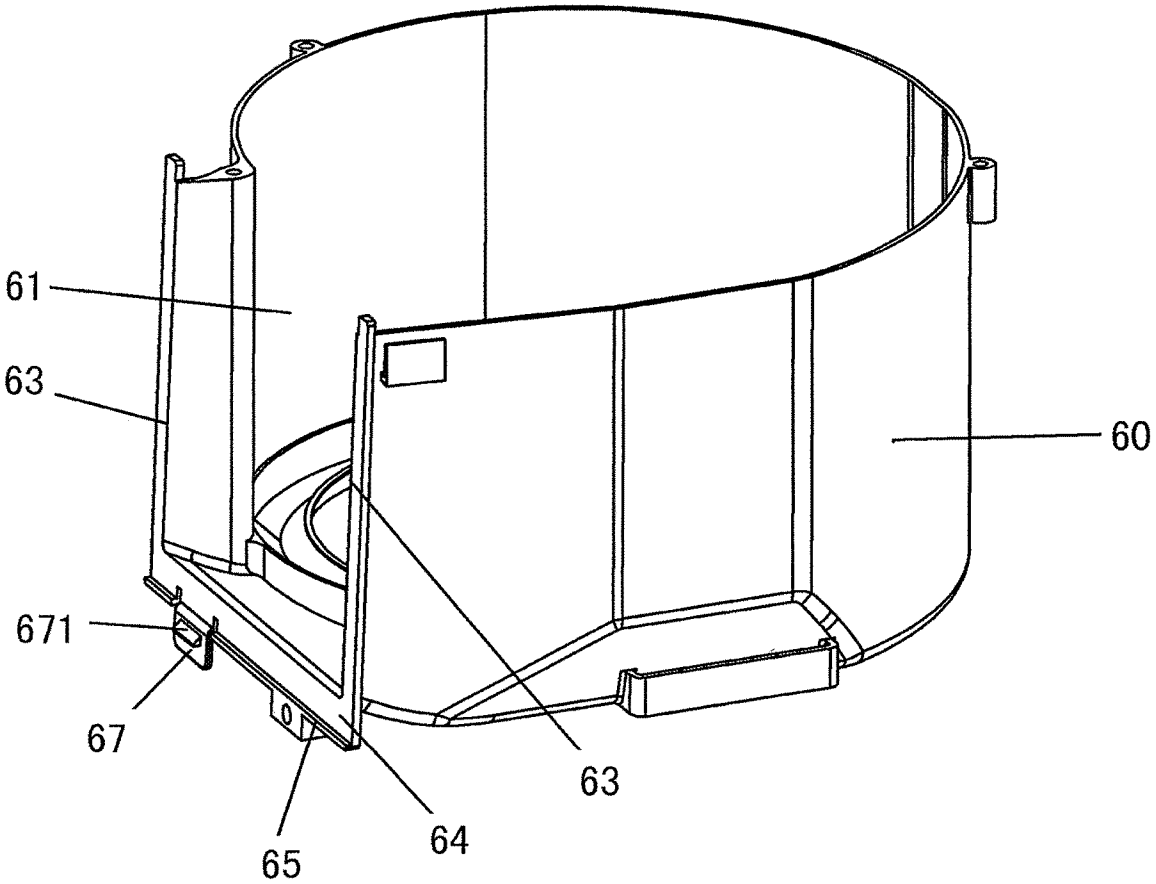
FIG. 3 is a schematic view of a casing according to an embodiment of the present invention.
Figure 4A:
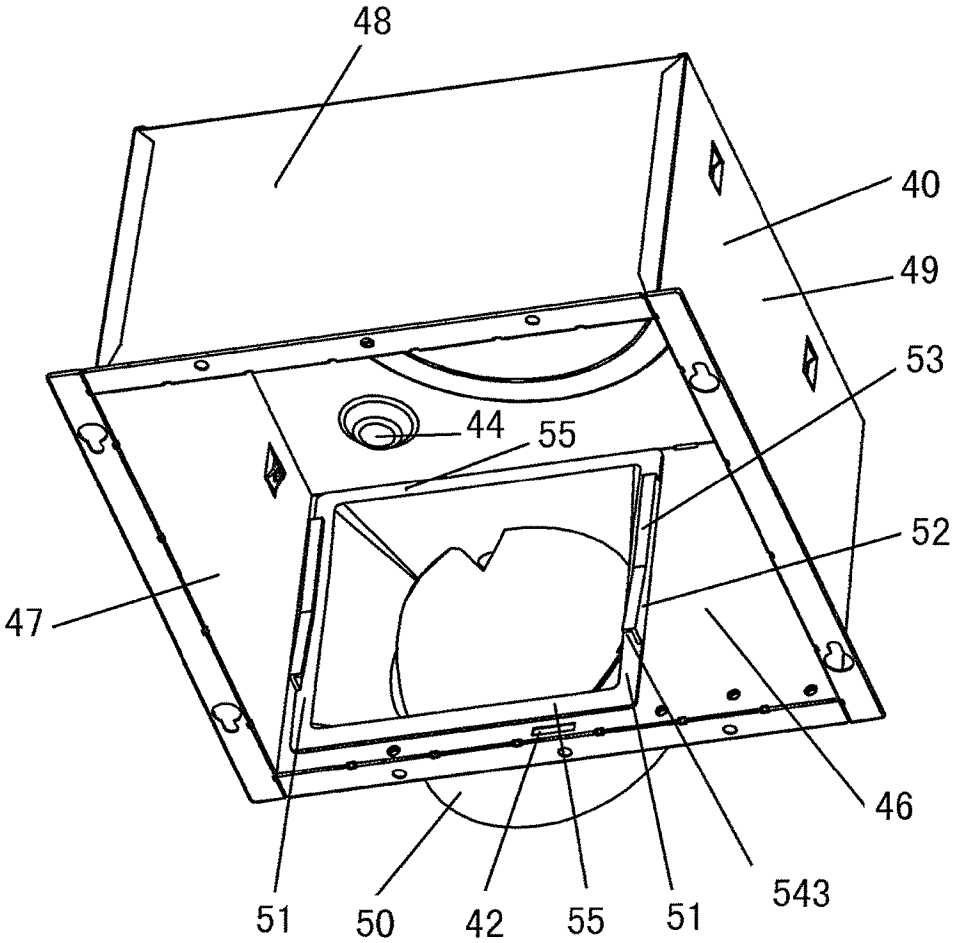
FIG. 4A is a schematically perspective view showing a frame of a ventilating fan according to an embodiment of the present invention.
Figure 4B:
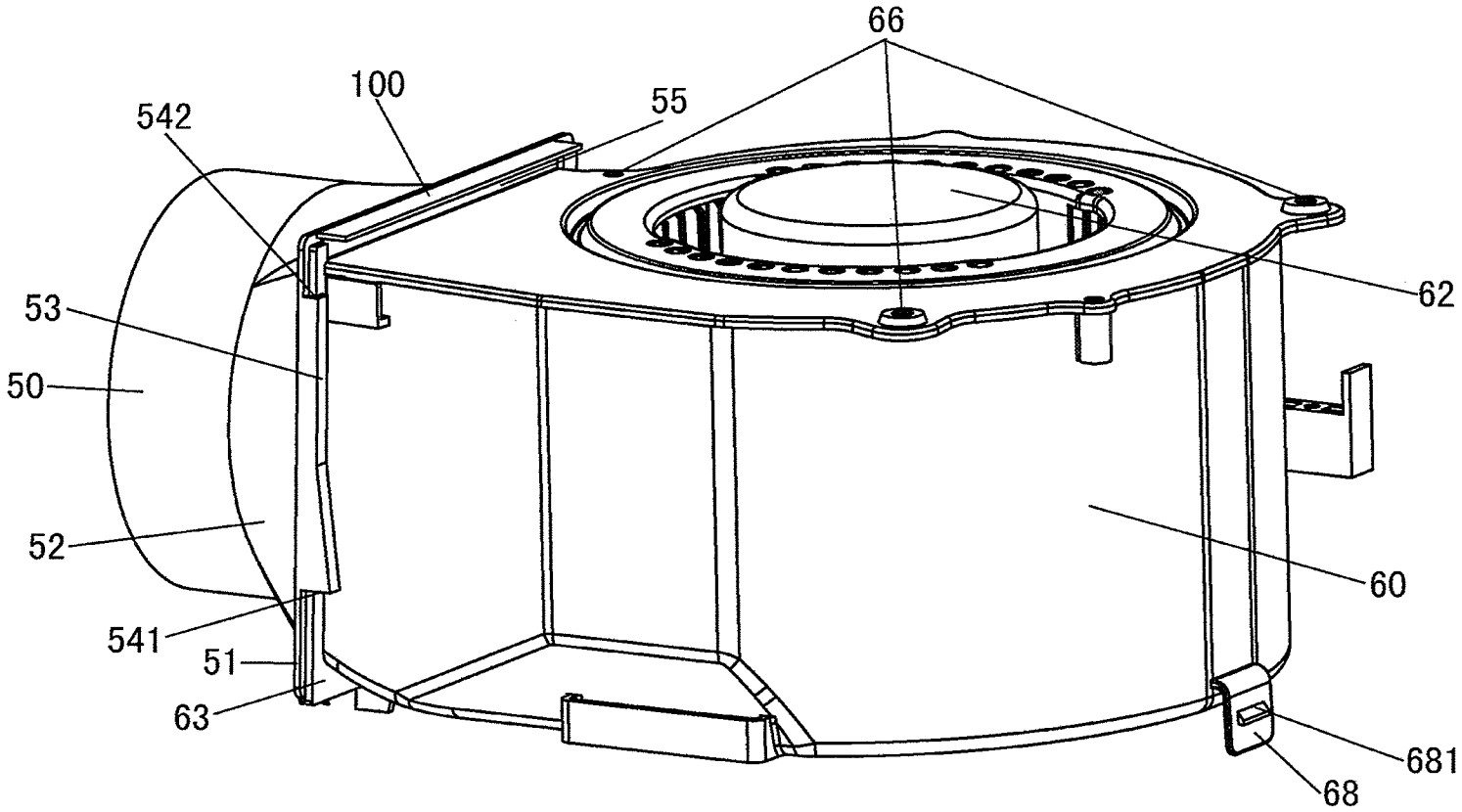
FIG. 4B is another schematically perspective view showing a casing of the ventilating fan according to the embodiment of the present invention.
Figure 4C:
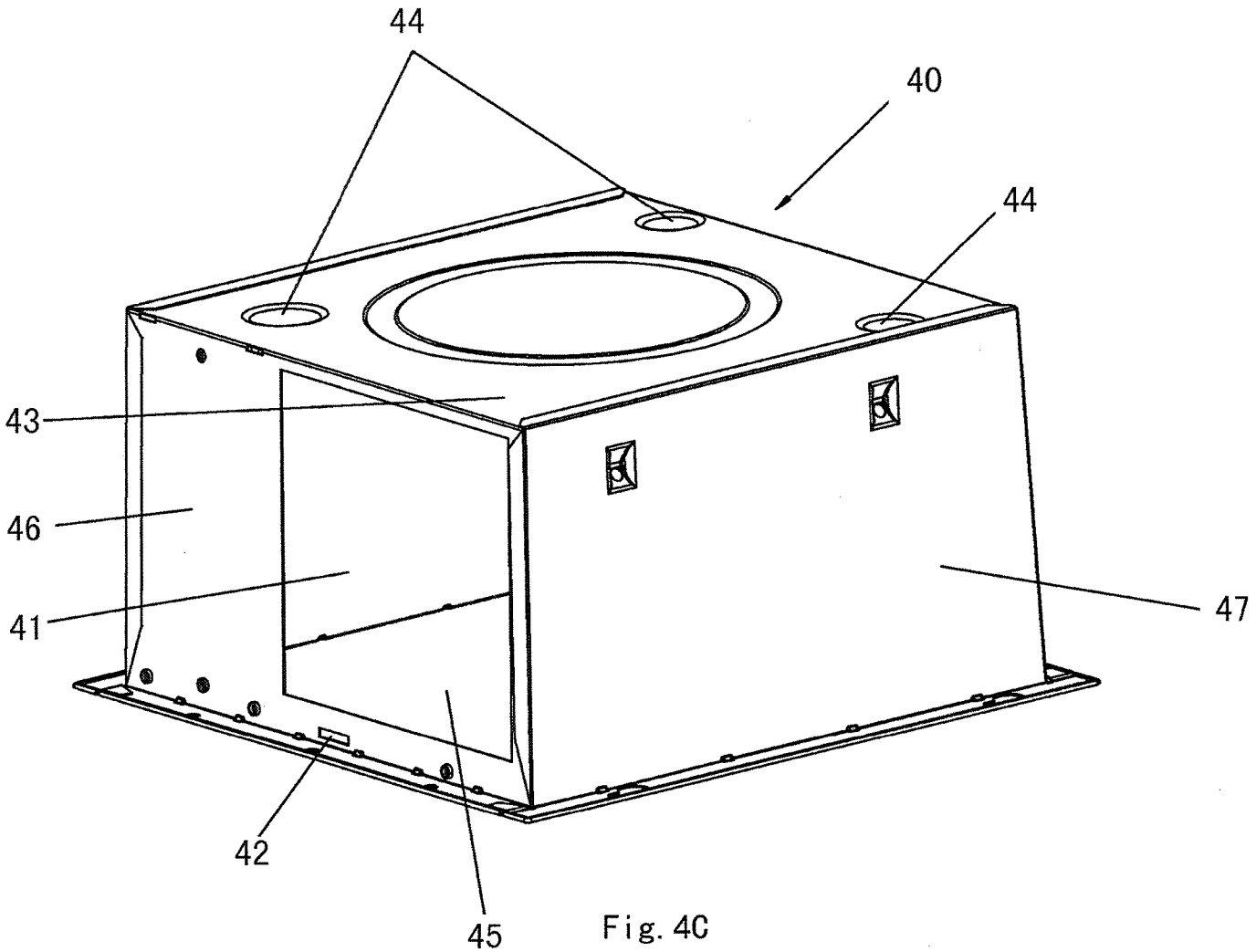
FIG. 4C is yet another schematically perspective view showing the frame of the ventilating fan according to the embodiment of the present invention.

FIGS. 2A and 2B are schematic views of an adapter according to an embodiment of the present invention, FIG. 3 is a schematic view of a casing according to the embodiment of the present invention; FIG. 4A is a schematically perspective view showing a frame of a ventilating fan according to the embodiment of the present invention; FIG. 4B is another schematically perspective view showing the casing of the ventilating fan according to the embodiment of the present invention; and FIG. 4C is yet another schematically perspective view showing the frame of the ventilating fan according to the embodiment of the present invention.

As shown in the figures, a ventilating fan 30 according to the embodiment of the present invention comprises a frame 40 which has a bottom surface 45 formed with an air inlet and a side surface 46 provided with an air outlet 41; a casing 60 in which a fan motor 62 is mounted; and, an adapter 50 connected to an air outlet 61 of the casing 60. First flangings 51 are extended outwards from both vertical side edges (i.e., left and right side edges) of an air inlet 59 of the adapter 50, second flangings 55 are extended outwards from both horizontal side edges (upper and lower side edges) of the air inlet 59 of the adapter 50, outer edges of the first flangings 51 are firstly bent towards the casing 60 side to form both side surfaces 52 perpendicular to the first flangings 51, and then edges of the side surfaces 52 are bent towards each other to form edge surfaces 53, and, the first flangings 51, the side surfaces 52, and the edge surfaces 53 confine these open grooves 54. One or more protrusions 56 are disposed on an outer periphery of the air inlet 59 of the adapter 50 near the first flanging 51 or the second flanging 55, and a slot 57 is formed between the protrusion 56 and any one of the first flanging 51 and the second flanging 55; and first folded sheets 63 are extended outwards from both vertical side edges (i.e., left and right side edges) of the air outlet 61 of the casing 60. A second folded sheet 64 is extended from a lower side edge of the air outlet 61 of the casing 60 towards an outside of the air outlet 61 of the casing 60. The casing 60 is provided with two snaps 67 and 68. The snaps 67 and 68 are provided with protrusions 671 and 681, respectively, and the frame 40 is formed with an engagement groove 42 corresponding to the protrusion 671, and an engagement groove (not shown) corresponding to the protrusion 681.

In this embodiment, provisions of the protrusions 56 and the slot 57 near the second flanging 55 is taken for example. However, according to actual requirements, one or more protrusions may also be disposed on the outer periphery of the air inlet 59 of the adapter 50 near the first flanging 51, and a slot is formed between the protrusion and the first flanging 51.

As shown in the figures, in this embodiment, the casing 60 is provided with the two snaps 67 and 68. The snap 67 is disposed on the second folded sheet 64, and the snap 68 is disposed on a part of the casing 60 opposite to the snap 67. The snaps 67 and 68 are provided with the protrusions 671 and 681, respectively. Each of the snaps 67 and 68 has one surface inclined from the casing 60 side in a direction away from the casing 60, and another surface disposed horizontally. When the casing 60 is mounted to the frame 40 from below upwards, the protrusion 671 will slide into the engagement groove 42 through the inclined surface so that the protrusion 671 can easily enter the engagement groove 42. In this way, the horizontally disposed surface will be engaged with the engagement groove 42. Therefore, it is difficult for the protrusion to slide out of the engagement groove 42. As a result, the casing 60 is temporarily fixed to the frame 40 and will not fall down. Hence, the mounting is much more convenient and easier, and, even one person can complete the mounting.

During the mounting, firstly, the frame 40 is fixed to joists (not shown) and then the adapter 50 is passed through the air outlet 41 at the side surface 46 of the frame 40 from an inside of the frame 40. The one or more protrusions 56 are disposed near the first flanging 51 or the second flanging 55, and the slot 57 is formed between the protrusion 56 and any one of the first flanging 51 and the second flanging 55. An edge of the air outlet 41 of the frame 40 abuts against and is clamped in the slot 57 such that the adapter 50 is locked onto the frame 40. Next, the first folded sheets 63 at the air outlet 61 of the casing 60 are inserted into the open grooves 54 of the adapter 50 from below upwards while the protrusion 671 of the snap 67 disposed on the casing 60 is engaged into the engagement groove 42 disposed in the frame 40 and corresponding to the protrusion 671, and the protrusion 681 is engaged into the corresponding engagement groove (not shown). In this way, the casing 60 is temporarily fixed inside the frame 40. In order to firmly fix the casing 60 inside the frame 40, the frame 40 and the casing 60 each needs to be formed with one, two or more openings 44 and 66 in corresponding positions in advance. Then, screws are passed through the openings 44 and 66 to fix the casing 60 inside the frame 40. In this way, since the casing 60 is connected with the adapter 50 by inserting the first folded sheets 63 at the air outlet 61 of the casing 60 into the open grooves 54 disposed at the air inlet 59 of the adapter 50, it is not necessary to use a screw to perform the connection. The adapter 50 is closely connected with the casing 60 by the open grooves 54 and the air tightness therebetween is highly ensured.

In this way, the adapter 50 can be mounted simply and conveniently, and the tightness between the adapter 50 and the air outlet 61 of the casing 60 is improved.

Figure 5:
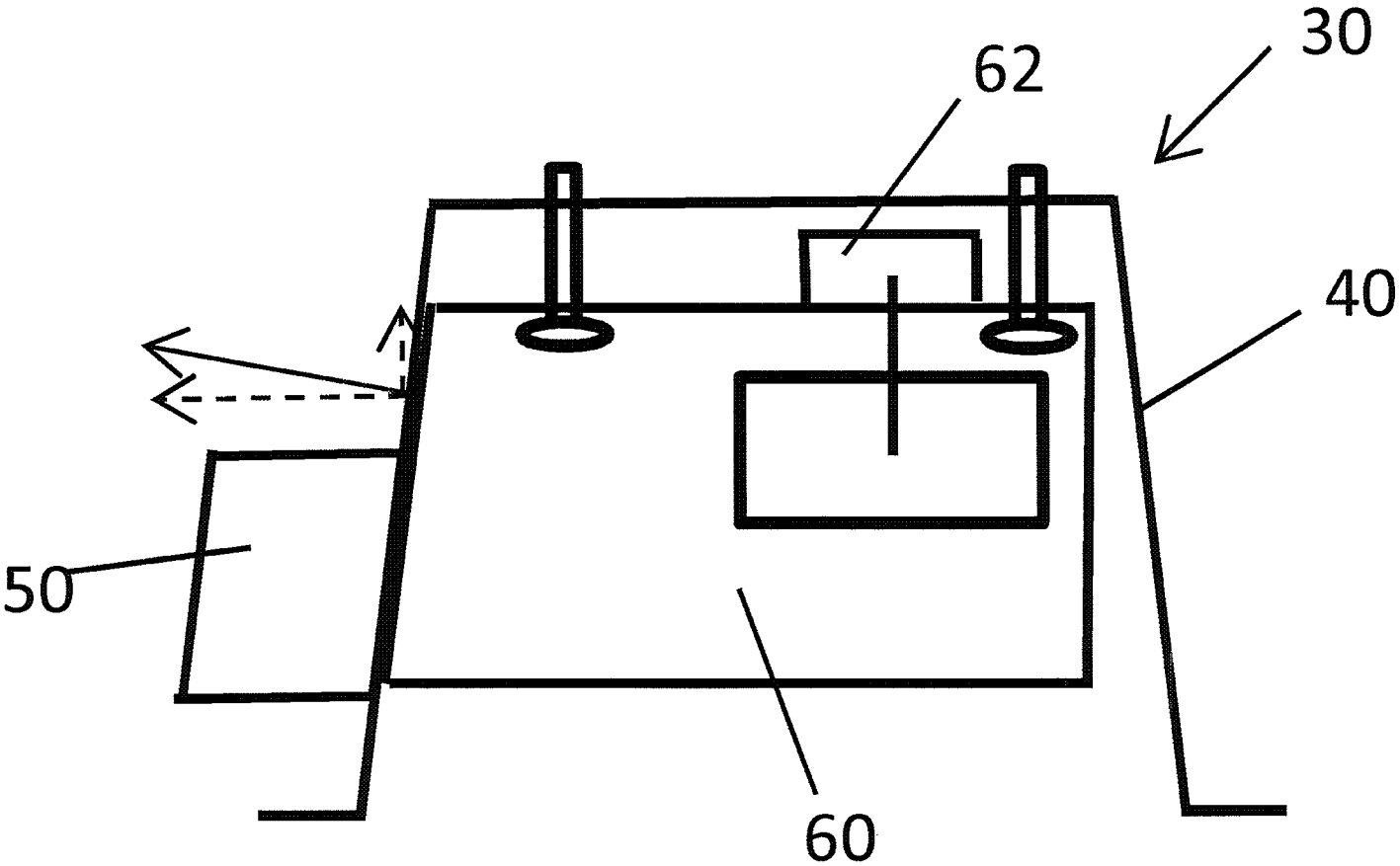
FIG. 5 is a schematically sectional view showing a mounting of the casing of the ventilating fan according to the embodiment of the present invention.

FIG. 5 is a schematically sectional view showing the mounting of the casing to the ventilating fan according to the embodiment of the present invention. As shown in FIGS. 4C and 5, four side surfaces 46, 47, 48, and 49 of the frame 40 excluding a top surface 43 and a bottom surface 45 are inclined outwards and downwards from the top surface 43 towards the bottom surface 45, with the inclination angle of 0.5-5 degrees. In other words, the frame 40 is formed in a trapezoidal shape. Since the inclination angle is set to be 0.5-5 degrees, and thus is small, it will not greatly affect the performance of the product.

The air outlet 41 at the side surface 46 of the frame 40, the air inlet 59 of the adapter 50, and the air outlet 61 of the casing 60 are parallel to one another. In other words, the air inlet 59 of the adapter 50, and the air outlet 61 of the casing 60 are inclined at the same angle as the side surface 46 of the frame 40 where the air outlet 41 is disposed.

The first folded sheets 63 at the air outlet 61 of the casing 60 are inserted into the open grooves 54 of the adapter 50 from below upwards while the protrusion 671 of the snap 67 disposed on the casing 60 is engaged into the engagement groove 42 disposed in the frame 40 and corresponding to the protrusion 671, and the protrusion 681 is engaged into the corresponding engagement groove (not shown). The casing 60 is temporarily fixed inside the frame 40. In order to firmly fix the casing 60 inside the frame 40, the frame 40 and the casing 60 each needs to be formed with one, two or more openings 44 and 66 in corresponding positions in advance. The casing 60 is fixed to the top surface 43 of the frame 40 by the screws. As a result, an upwardly urging force is applied to the casing 60, and, an upward acting force, and a horizontal acting force towards the adapter 50 are applied to the side surface of the frame 40 by the side surface of the casing 60 where the air outlet 61 is disposed so that the connection between the casing 60 and the adapter 50 is more tightly to improve the tightness.

Furthermore, as shown in FIGS. 2A and 4B, a lower opening 541 of the open groove 54 is greater than an upper opening 542 of the open groove 54, and the lower opening 541 of the open groove 54 is gradually narrowed upwards to form a guide groove 543. The lower opening of the open groove 54 is gradually narrowed upwards until it is just slightly wider than the folded sheet of the casing 60 and can closely clamp the first folded sheet 63 of the casing 60 therein. In other words, when the outer edges of the first flangings 51 are bent towards the casing 60 side to form the both side surfaces 52 perpendicular to the first flangings 51, width of a lower portion of the side surface 52 is greater than that of an upper portion of the side surface 52, and the width of the side surface is gradually reduced upwards. After the edges of the side surfaces 52 are bent to form the edge surfaces 53, the lower portion of the open groove 54 is formed into the guide groove 543 of which the opening is gradually reduced upwards.

With the above-mentioned structure, when the first folded sheets 63 of the air outlet 61 of the casing 60 are inserted into the open grooves 54 of the adapter 50 from below upwards, the first folded sheets 63 can be very easily inserted accurately into the lower portion having the greater opening, and then the first folded sheets 63 are moved into the guide grooves. The first folded sheets 63 are accurately entered the upper portions having the smaller openings by guidance of the guide grooves 543 of which the openings are gradually reduced upwards. In this way, the first folded sheets 63 of the casing 60 are very smoothly inserted closely into the open grooves 54 of the adapter 50.

Figure 6A:
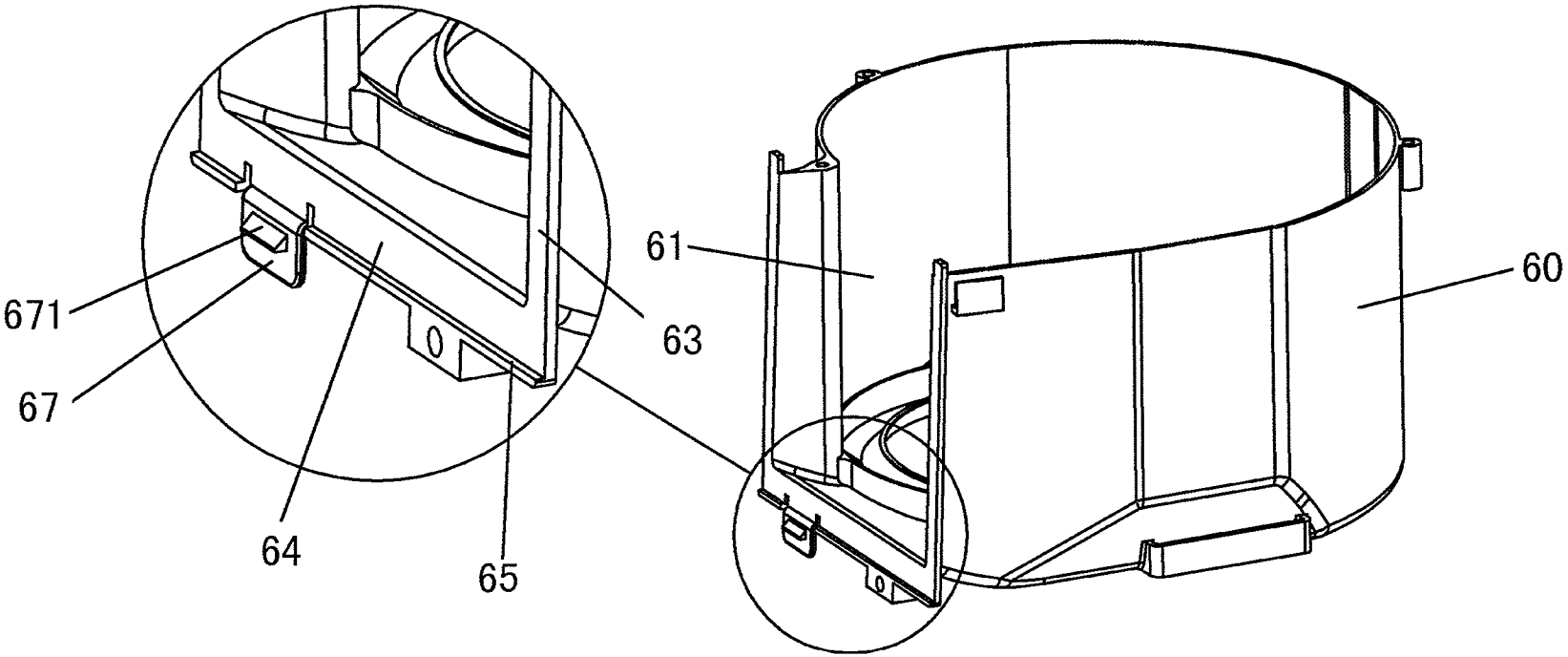
FIGS. 6A and 6B are schematic views showing a second folded sheet of the casing of the ventilating fan according to the embodiment of the present invention.
Figure 6B:
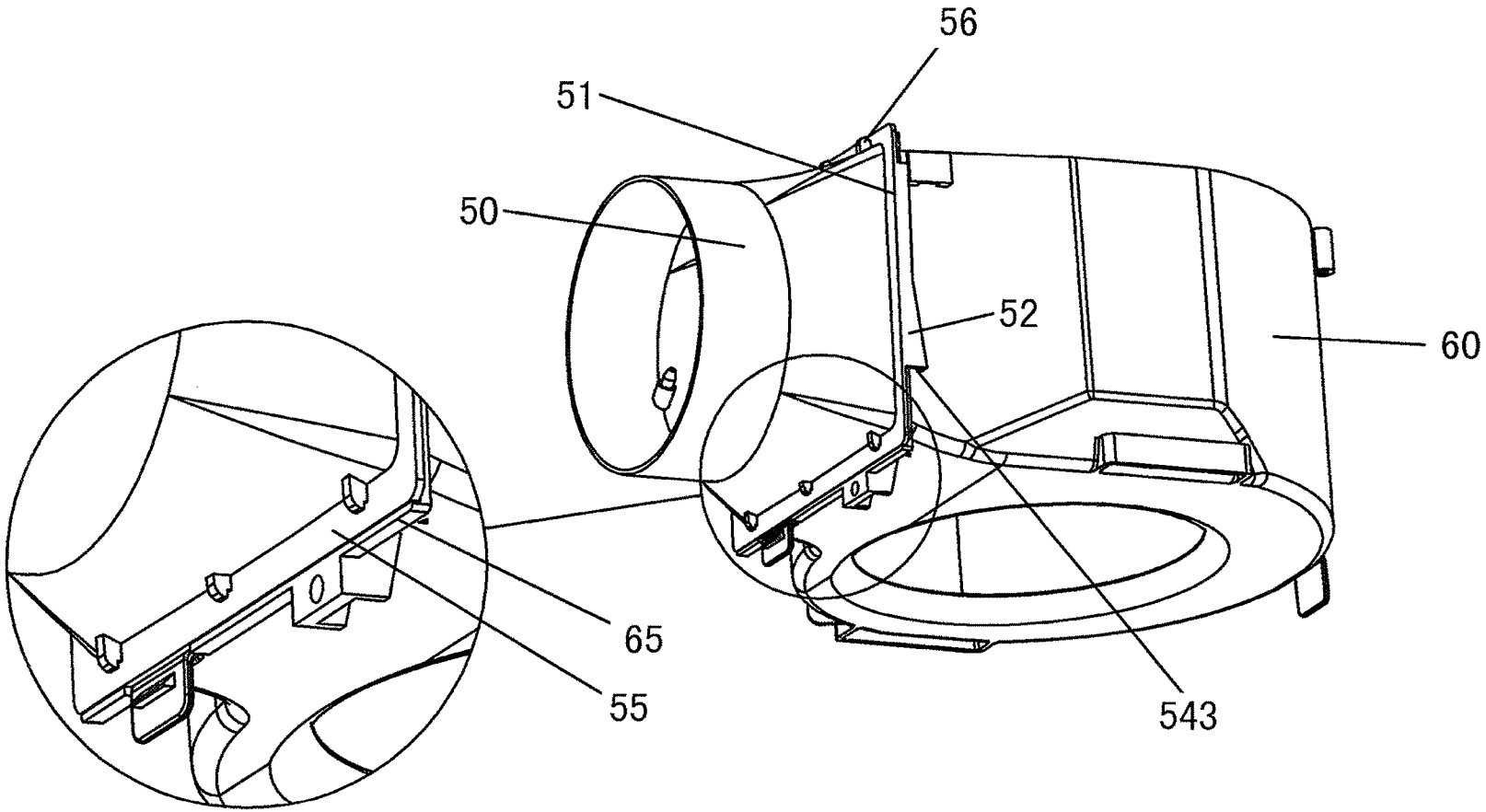

FIGS. 6A and 6B are schematic views showing a second folded sheet of the casing of the ventilating fan according to the embodiment of the present invention. As shown in FIGS. 6A, 6B, and 2A, a second folded sheet 64 is extended from a lower side edge of the air outlet 61 of the casing 60 towards an outside of the air outlet 61 of the casing 60, and a lower portion of the second folded sheet 64 is perpendicularly bent towards the adapter 50 side to form a stop sheet 65.

In addition, as shown in FIG. 4B, an upper portion of the second flanging 55 is perpendicularly bent towards the casing 60 side to form a stop piece 100.

When the adapter 50 and the casing 60 are connected together, the first flangings 51 and the second flanging 55 of the adapter 50 and the first folded sheets 63 and the second folded sheet 64 of the casing 60 abut against each other, to enhance air tightness and prevent air leakage.

For example, the lower portion of the second folded sheet 64 having a width of 20 mm is perpendicularly bent towards the adapter 50 side to form the stop sheet 65 having a width of around 1-2 mm. After the first folded sheets 63, which have a width of 10 mm, of the air outlet 61 of the casing 60 are inserted to an appropriate position in the open grooves 54 of the adapter 50 from below upwards (i.e., in a position where the air outlet 61 of the casing 60 is completely aligned with the air inlet 59 of the adapter 50), the stop sheet 65 at the lower portion of the second folded sheet 64 having the width of 20 mm will be stopped by the second flanging 55 disposed on the lower side of the adapter 50, and the casing 60 cannot be further pushed upwards. In other words, the casing 60 cannot be further pushed over the appropriate position.

In addition, even if the stop sheet 65 fails due to wear, it can be stopped by the stop piece 100 of the second flanging 55 so that the casing 60 cannot be further moved upwards.

Therefore, it can be ensured that the air outlet 61 of the casing 60 is completely aligned with the air inlet 59 of the adapter 50, and misalignment between them cannot occur, thereby improving the tightness between the adapter 50 and the air outlet 61 of the casing 60.

The invention claimed is:

1. A ventilating fan, comprising:

a frame which has a bottom surface formed with an air inlet and four side surfaces one of which is provided with an air outlet;

a casing in which a fan motor is mounted and which has an air outlet having two vertical side edges;

an adapter fitted to the air outlet of the casing and comprising:

an air inlet having two vertical side edges and two horizontal side edges;

a first flanging extended outwards from each of the two vertical side edges of the air inlet of the adapter, and each of the first flangings having an outer edge;

a second flanging extended outwards from each of the two horizontal side edges;

a side surface bent from the outer edge of each of the first flangings towards a casing side, being perpendicular to each of the first flangings and each of the two side surfaces of the adapter having an edge located on the casing side;

an edge surface bent from each of the edges of the two side surfaces of the adapter, the edge surfaces being bent towards each other, wherein the first flangings, the two side surfaces of the adapter, and the edge surfaces form open grooves;

one or more protrusions disposed on an outer periphery of the air inlet of the adapter near the first flangings or the second flangings; and a slot formed between the one or more protrusions and any one of the first and the second flangings, wherein:

the casing comprises a first folded sheet extended outwards from each of the two vertical side edges of the air outlet of the casing; and an edge of the air outlet of the frame abuts against and is clamped in the slot such that the adapter is locked to the frame, and each of the first folded sheets is insertable into one of the open grooves of the adapter.

2. The ventilating fan of claim 1, wherein: the four side surfaces of the frame excluding a top surface and the bottom surface are inclined outwards and downwards from the top surface towards the bottom surface, and the air outlet at the side surface of the frame, the air inlet of the adapter, and the air outlet at the casing are parallel to one another.

3. The ventilating fan of claim 2, wherein: the four side surfaces are inclined outwards and downwards from the top surface towards the bottom surface at an angle of 0.5-5 degrees.

4. The ventilating fan of claim 1, wherein: a lower opening of each of the open grooves is greater than an upper opening of each of the open grooves, and the lower opening of each of the open grooves is gradually narrowed upwards to form a guide groove.

5. The ventilating fan of claim 4, wherein: the lower opening of each of the open grooves is gradually narrowed upwards until the lower opening of each of the open grooves is slightly wider than a corresponding one of the first folded sheets of the casing and closely clamps the first folded sheets of the casing.

6. The ventilating fan of claim 1, wherein: the casing further comprises a second folded sheet extended from a lower side edge of the air outlet of the casing towards an outside of the air outlet of the casing, and a lower portion of the second folded sheet is perpendicularly bent towards the adapter side to form a stop sheet; and when the adapter and the casing are connected together, the first and second flangings of the adapter and the first and second folded sheets of the casing abut against each other.

7. The ventilating fan of claim 1, wherein: the casing is provided with a snap.

8. The ventilating fan of claim 7, wherein: the snap is provided with a protrusion, and the frame is formed with an engagement groove corresponding to the protrusion.

9. The ventilating fan of claim 1, wherein: an upper portion of the second flanging is perpendicularly bent towards the casing side to form a stop piece.

* * * * *